US009651052B2

(12) United States Patent
Boussekey et al.

(10) Patent No.: US 9,651,052 B2
(45) Date of Patent: May 16, 2017

(54) DEVICE FOR SECURING AND ELECTRICALLY CONNECTING A SEALED COMPRESSOR

(71) Applicant: TECUMSEH EUROPE SALES & LOGISTICS SAS, Vaulx Milieu (FR)

(72) Inventors: Pierre Boussekey, Villefontaine (FR); Sophie Özdemir, Villefontaine (FR); Rémi Pitiot, Saint Chef (FR); Xavier Durand, Vaulx Milieu (FR)

(73) Assignee: TECUMSEH EUROPE SALES & LOGISTICS SAS, Vaulx Milieu (FR)

( * ) Notice: Subject to any disclaimer, the term of this patent is extended or adjusted under 35 U.S.C. 154(b) by 0 days.

(21) Appl. No.: 15/106,186

(22) PCT Filed: Dec. 17, 2014

(86) PCT No.: PCT/EP2014/078285
§ 371 (c)(1),
(2) Date: Jun. 17, 2016

(87) PCT Pub. No.: WO2015/091683
PCT Pub. Date: Jun. 25, 2015

(65) Prior Publication Data

US 2016/0319824 A1 Nov. 3, 2016

(30) Foreign Application Priority Data

Dec. 20, 2013 (FR) ..... 13 63340

(51) Int. Cl.
*H01R 27/00* (2006.01)
*F04D 25/06* (2006.01)
(Continued)

(52) U.S. Cl.
CPC ..... *F04D 25/0693* (2013.01); *F04B 35/04* (2013.01); *F04B 39/121* (2013.01);
(Continued)

(58) Field of Classification Search
CPC .... F04D 25/0693; F04D 26/06; F04D 29/403; F04B 35/04; F04B 39/121; F04B 39/14;
(Continued)

(56) References Cited

U.S. PATENT DOCUMENTS 5,173,057 A 12/1992 Bunch et al.
5,664,959 A * 9/1997 Duell ..... H01R 13/5219 439/278
(Continued)

FOREIGN PATENT DOCUMENTS

CH 659 918 A5 2/1987
EP 0 422 336 A1 4/1991
(Continued)

*Primary Examiner* — Khiem Nguyen
(74) *Attorney, Agent, or Firm* — Baker & Hostetler LLP

(57) ABSTRACT

A sealed compressor comprises a motor pump unit, a hermetic casing and means of electrical connection, the motor pump unit positioned inside the hermetic casing, the connection means allowing the motor pump unit to be powered electrically through the hermetic casing, the connection means comprising an earth rod and at least two power supply terminals. The connection means comprise a mobile housing and a power supply cable, the housing arranged at the end of the cable, connection of the housing to the earth rod and to the power supply terminals achieved in a translational movement in a direction of insertion. Connection of the housing to the earth rod comprises non-return means that prevent the housing from moving in an opposite direction to the direction of insertion.

16 Claims, 7 Drawing Sheets

(51) Int. Cl.

| | |
|---|---|
| ***F04B 35/04*** | (2006.01) |
| ***F04B 39/12*** | (2006.01) |
| ***F04B 39/14*** | (2006.01) |
| ***H01R 4/64*** | (2006.01) |
| ***F04C 23/00*** | (2006.01) |
| ***F04B 53/16*** | (2006.01) |
| ***F04C 29/00*** | (2006.01) |
| ***F04D 29/40*** | (2006.01) |
| ***H01R 13/639*** | (2006.01) |
| ***H01R 13/652*** | (2006.01) |
| ***H01R 13/74*** | (2006.01) |
| ***H01R 33/97*** | (2006.01) |
| *H01R 9/16* | (2006.01) |

(52) U.S. Cl.

CPC ..... *F04B 39/14* (2013.01); *F04B 53/16* (2013.01); *F04C 23/008* (2013.01); *F04C 29/0085* (2013.01); *F04D 25/06* (2013.01); *F04D 29/403* (2013.01); *H01R 4/64* (2013.01); *H01R 13/6392* (2013.01); *H01R 13/652* (2013.01); *H01R 13/74* (2013.01); *H01R 33/97* (2013.01); *F04C 2240/30* (2013.01); *F04C 2240/803* (2013.01); *H01R 9/16* (2013.01); *H01R 2201/00* (2013.01)

(58) Field of Classification Search

CPC F04C 23/008; F04C 29/0085; F04C 2240/30; H01R 13/6392; H01R 13/652; H01R 13/74; H01R 33/97; H01R 2201/00

USPC ..... 439/217, 218, 352, 638, 641, 685, 689

See application file for complete search history.

(56) References Cited

U.S. PATENT DOCUMENTS 6,159,041 A * 12/2000 Davis ..... H01R 13/5213 439/559

6,290,528 B1 * 9/2001 Moore, Jr. ..... H01R 13/5216 439/271

FOREIGN PATENT DOCUMENTS

FR 2 065 945 A5 8/1971

FR 2 977 407 A1 1/2013

* cited by examiner

DEVICE FOR SECURING AND ELECTRICALLY CONNECTING A SEALED COMPRESSOR

CROSS-REFERENCE TO RELATED APPLICATIONS

This application is a National Stage of International patent application PCT/EP2014/078285, filed on Dec. 17, 2014, which claims priority to foreign French patent application No. FR 1363340, filed on Dec. 20, 2013, the disclosures of which are incorporated by reference in their entirety.

FIELD OF THE INVENTION

The invention relates to the electrical connection of a sealed compressor used for example for domestic or commercial refrigeration and for air conditioning.

More generally, in a thermodynamic machine, a compressor is used to compress a refrigerant fluid before passing it through a heat exchanger to cool the fluid in contact with a heat source.

BACKGROUND

Various types of compressors are known, for example reciprocating or rotary. The compressor is for example driven by an electric motor and the assembly formed by the compressor and the motor is called a moto compressor. In refrigeration machines, the compressor and the motor associated with it are usually enclosed inside a hermetic casing. The component thus produced is hereinafter called a sealed compressor. The electrical connection of the motor passes through the hermetic casing and the sealed compressor is supplied with several terminals emerging from the casing to which a power supply cable is connected during installation of the thermodynamic machine.

The cable ends in electrical connection means which are plugged onto the power supply terminals of the sealed compressor. This assembly is then covered with an electrical cover to ensure the safety of the equipment and persons using the equipment operating the thermodynamic machine. Furthermore, means for connection to earth, connected to a particular terminal passing through the casing, is used to connect the equipment to an earth connection provided by the mains power supply for the equipment.

This terminal, called the earth terminal, is connected to a specific electric conductor of the power supply cable. This specific conductor is usually insulated by means of an insulation with a particular green and yellow color. To ensure proper connection of the specific conductor to the earth terminal, use is made of a particular connection means different to the connection means for the other conductors of the power supply cable carrying electric power. For example, the power conductors end in lugs which are simply plugged onto the power supply terminals and the earth conductor ends in a lug which is screwed onto the earth terminal.

Connecting the various conductors of the cable to the terminals passing through the casing of the sealed compressor is subject to error which can lead to immediate or short term destruction of the compressor.

In addition, the time required for connection may vary depending on the accessibility of the connection terminals of the equipment.

SUMMARY OF THE INVENTION

The invention aims to ensure reliable connection of the cable to the terminals of the compressor. The invention also seeks to improve the speed of connection of the cable.

To this end, the invention relates to a sealed compressor comprising a motor pump unit, a hermetic casing and means of electrical connection, the motor pump unit being positioned inside the hermetic casing, the connection means allowing the motor pump unit to be powered electrically through the hermetic casing, the connection means comprising an earth rod and at least two power supply terminals, characterized in that the connection means comprise a mobile housing and a power supply cable, the housing being arranged at the end of the cable, connection of the housing to the earth rod and to the power supply terminals being achieved in a translational movement in a direction of insertion, in that connection of the housing to the earth rod comprises non-return means that prevent the housing from moving in an opposite direction to the direction of insertion, in that the earth rod is formed of a rod extending out of the hermetic casing in a direction comprising the direction of insertion, in that the housing comprises a one-piece mechanical part intended to ensure the connection of the housing to the earth rod, in that the housing comprises two parts: a base and a cover, in that the mechanical part is rigidly secured to the base, in that the cover is removably attached to the base and in that the base is made of an electrically insulating material so as to avoid any electrical contact between components located inside the housing and the hermetic casing.

In a preferred embodiment, the non-return means prevent the housing from moving in an opposite direction to the direction of insertion simply due to pulling on the housing, while allowing the housing to move in an opposite direction to the direction of insertion when the pulling force in an opposite direction to the direction of insertion is combined with another maneuver other than pulling. This embodiment may be implemented regardless of whether the mechanical connection part is in one piece and regardless of the presence of two parts: base and cover, forming the housing.

BRIEF DESCRIPTION OF THE DRAWINGS

The invention will be better understood and other advantages will become apparent on reading the detailed description of an embodiment given as an example, the description being illustrated by the attached drawing, in which.

For the sake of clarity, the same elements bear the same reference signs in the various figures.

DETAILED DESCRIPTION

Figure 1:
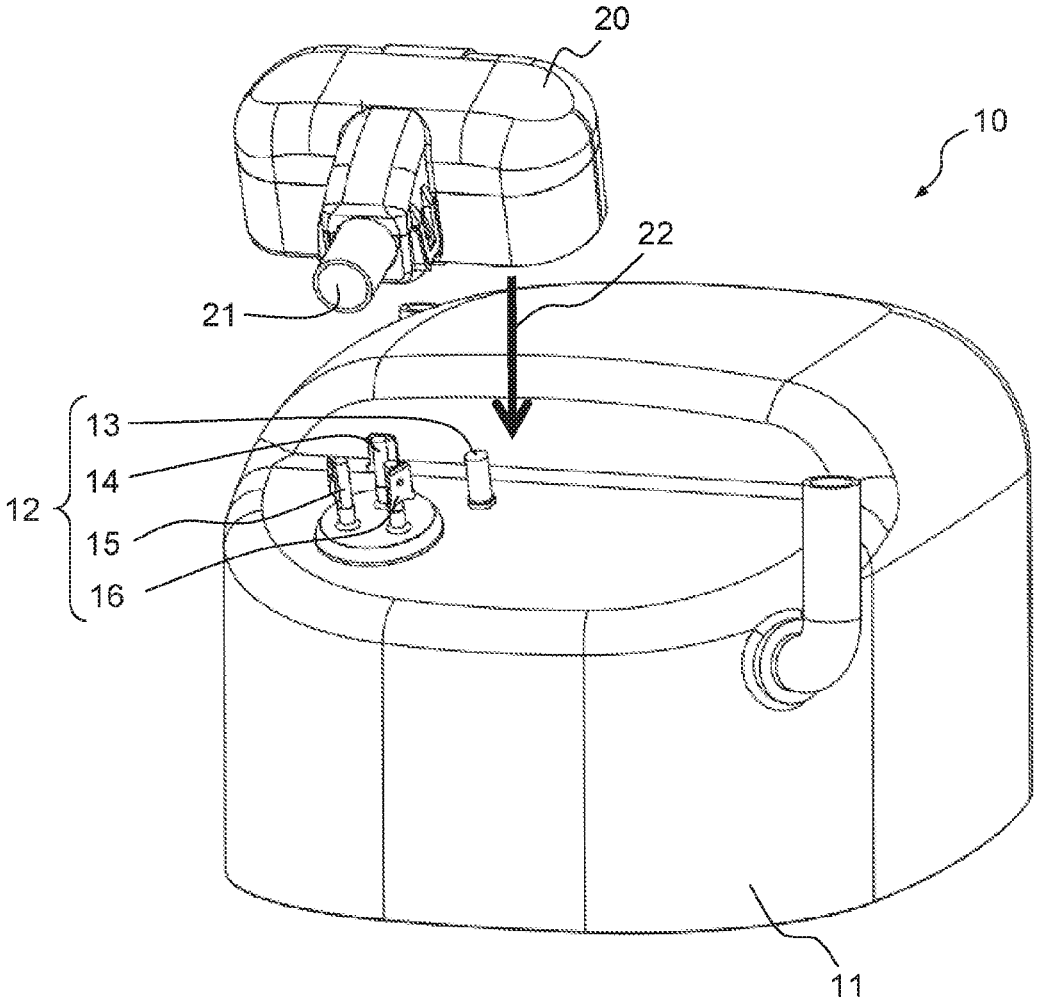
FIG. 1 shows, in perspective, part of the casing of a sealed compressor according to the invention as well as, from a distance, a housing forming the end of a power supply cable.

FIG. 1 shows a sealed compressor 10 comprising a hermetic casing 11 and a motor pump unit not visible in the figure as it is positioned inside the hermetic casing 11. The sealed compressor 10 also includes connection means 12 for supplying power to the motor pump unit passing through the hermetic casing 11. The connection means 12 comprise an earth rod 13 and at least two power supply terminals. In the example shown, the connection means 12 comprise three power supply terminals 14, 15 and 16 passing through the hermetic casing 11. Two of the terminals are intended to receive a phase and the third electric connection terminal may receive one of the phases of the mains power supply in the case of a three-phase network.

Alternatively, in single phase, one of the three connections may be connected to a thermal protection component that will be described later. In this case, the other two terminals are connected to an additional item of electrical equipment, not shown, located outside of the sealed compressor 10, for example for generating an auxiliary phase that may be used to determine the direction of rotation of the motor pump unit when it starts up. The earth rod 13 is intended to receive a protective earth provided by the mains.

The connection means 12 comprise a mobile housing 20 and a power supply cable 21, the housing 20 being arranged at one end of the cable 21. The cable 21 comprises for example four insulated conductors conveying power to the compressor 10.

Connection of the housing 20 to the earth rod 13 and to the power supply terminals 14, 15 and 16 is achieved in a translational movement, in a direction of insertion shown by the arrow 22.

Figure 2:
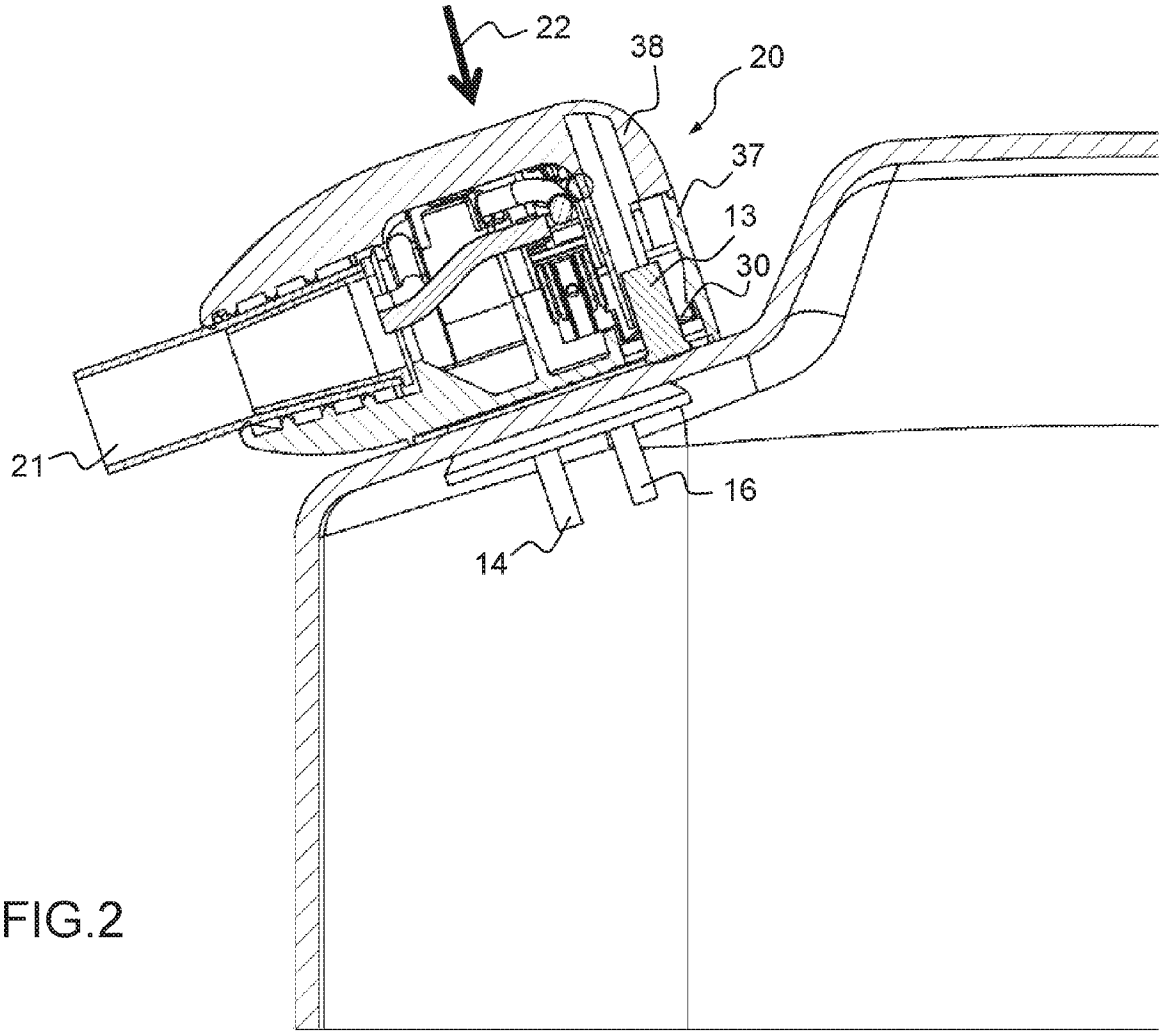
FIG. 2 shows, in cross section, the compressor casing and the housing connected to the terminals of the compressor.

FIG. 2 shows, in cross section, the housing 20 connected to the power supply terminals 13, 14 and 16 thereof.

The connection of the housing 20 to the earth rod 13 comprises non-return means that prevent the housing 20 from moving in an opposite direction to the direction of insertion 22.

The connection of the housing 20 to the earth rod 13 may comprise means for bracing on the earth rod 13. Bracing on the earth rod 13 is a simple way of achieving non-return of the housing 20.

The earth rod 13 is conventionally formed of a pin or a threaded rod having a threaded portion extending out of the hermetic casing 11 in a direction comprising the direction 22. It is also possible to form the earth rod 13 using a smooth rod emerging from the hermetic casing 11.

It is possible to differentiate between the electrical connection to the earth rod and the mechanical connection comprising the non-return means. The electrical connection may be achieved by means of a lug intended to surround the earth rod 13, comprising elastic means ensuring that the lug exerts a force on the rod 13 perpendicular to the direction comprising the direction 22. The mechanical connection may be achieved using an element that pivots with respect to the lug, bearing against the lug. The non-return effect may be ensured by gravity by providing a pivot axis of the pivoting element which is lower than the point of contact between the pivoting element and the rod 13. Thus, upon insertion, the pivoting element, which is for example circular, slides against the rod 13 without putting up in opposition any mechanical resistance, just a slight friction. By contrast, if a reverse movement is attempted, the circular element braces itself on the rod 13, thus putting up in opposition a force proportional to the force exerted in the attempt to uncouple the housing 20.

Advantageously, the housing 20 is connected to the earth rod 13 in such a way that an attempt at disconnection simply by pulling in an opposite direction to the direction of insertion 22 will destroy the connection to the earth rod 13. When the mechanical connection and the electrical connection are separate, it is possible to define the bracing or more precisely the relative position of the pivot axis and the point of contact of the pivoting element so as to calibrate a force allowing disconnection of the housing, for example by deformation of the circular fastening member. It is also possible to set a force that is high enough to exceed the elastic range and enter the range of plastic deformation or even cause the rupture of the lug intended to ensure connection to the earth rod 13. Permanent deformation or rupture will serve as proof of disconnection of the housing 20.

Alternatively, in a preferred variant of the invention, the electrical and mechanical connections to the earth rod 13 are achieved by a one-piece mechanical part 30. In other words, the housing 20 comprises a one-piece mechanical part for connecting the housing 20 to the earth rod 13. The mechanical part 30 is rigidly secured to the housing 20.

Figure 3:
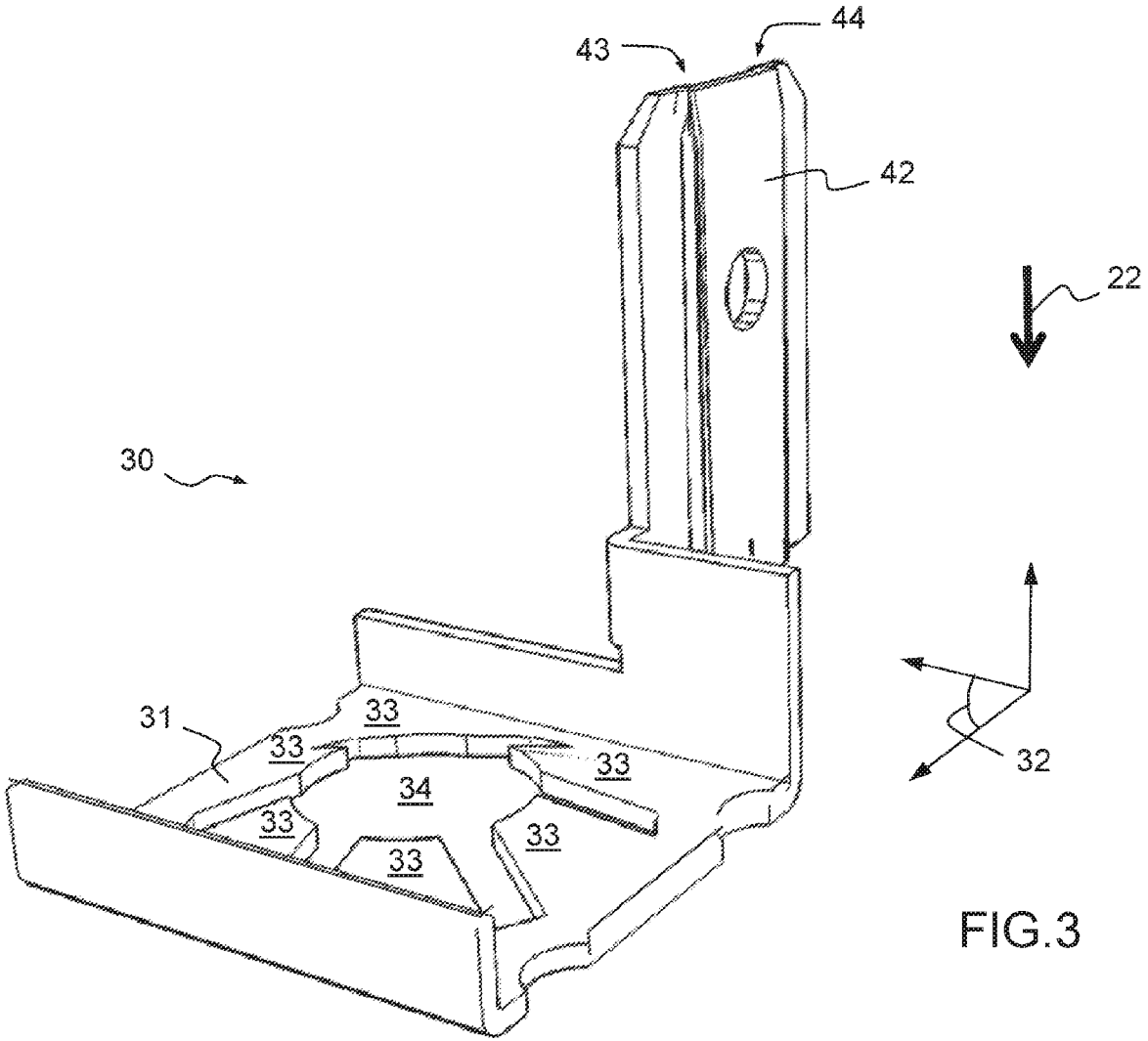
FIG. 3 shows a part for connecting the housing to a rod, which forms a fastening means and serves as electric earth connection of the compressor.

FIG. 3 shows the part 30 alone. The part 30, connected to the earth rod 13, is also visible in FIG. 2.

The one-piece mechanical part 30 includes a pierced washer 31 extending in a plane 32. The washer 31 is designed to surround the rod 13 so that the plane 32 of the washer 31 is placed perpendicular to the direction comprising the direction 22, the terminal 13 being inserted in the hole 34 in the washer 31. The washer 31 has at least one radial fin 33 partially blocking the hole 34 in the washer 31, so as to fit tightly on the rod 13.

Advantageously, the washer 31 comprises several symmetrical fins 33. In the example shown in FIG. 3, the washer 31 comprises six fins 33 extending symmetrically around the direction comprising the direction 22.

The fin or fins 33 are inclined relative to the plane 32 of the washer 31 in such a way that the inclination thereof is increased during insertion by elastic deformation. Thus, once the washer has been fitted on the rod 13, the elastic deformation of the fin or fins 33 clamps the washer 31 on the rod 13 and therefore ensures the electrical connection between the washer and the rod 13. Moreover, if an attempt is made to disconnect the housing 20 by exerting on the washer 31 a force in an opposite direction to the direction 22, this reduces the inclination of the fin or fins 33 bearing on the rod 13, increasing the clamping force of the washer 31 on the rod 13. This braces the washer 31 on the rod 13, preventing disconnection of the housing 20, thus ensuring the non-return effect that prevents the housing 20 from moving in an opposite direction to the direction of insertion 22. By increasing the disconnection force, it is however possible to tear off the housing 20. In such a case, the fin or fins 33 are deformed as the inclination thereof is reversed, something which can, depending on the material chosen for the washer, either irreparably deform the fin or fins 33, or break them if the material from which the washer is made has only a limited range of plastic deformation. This is for example the case of hardened steel with a high percentage of carbon. The mechanical part 30 is rigidly secured to the housing 20. Tearing off the housing 20 to disconnect it can also break the join between the part 30 and the housing 20. The housing 20 is for example made of plastic obtained by molding. Grooves made in the housing 20 and in the plane 32 may be used for anchoring the part 30. Disconnection of the housing may for instance break the grooves and thus break the anchoring of the part 30 in the housing 20.

The housing 20 and the power supply cable 21 at the end of which the housing 20 is arranged may be made at the plant, thus avoiding any risk of faulty connection of the cable 21 to the different terminals emerging from the hermetic casing 11. It may be necessary to intervene on site during use of the equipment to repair the cabling. To this end, the housing 20 comprises two parts: a base 37 and a cover 38. The mechanical part 30 is rigidly secured to the base 37. The cover 38 may be removably attached to the base 37. The removable attachment is achieved for example by screws or by clipping.

The base 37 is made of an electrically insulating material so as to avoid any electrical contact between the components located inside the housing 20 and the hermetic casing 11. More generally, the housing 20 comprises an electrically insulating material arranged in such a way as to avoid any electrical contact between components located inside the housing 20 and the hermetic casing 11.

Figure 4:
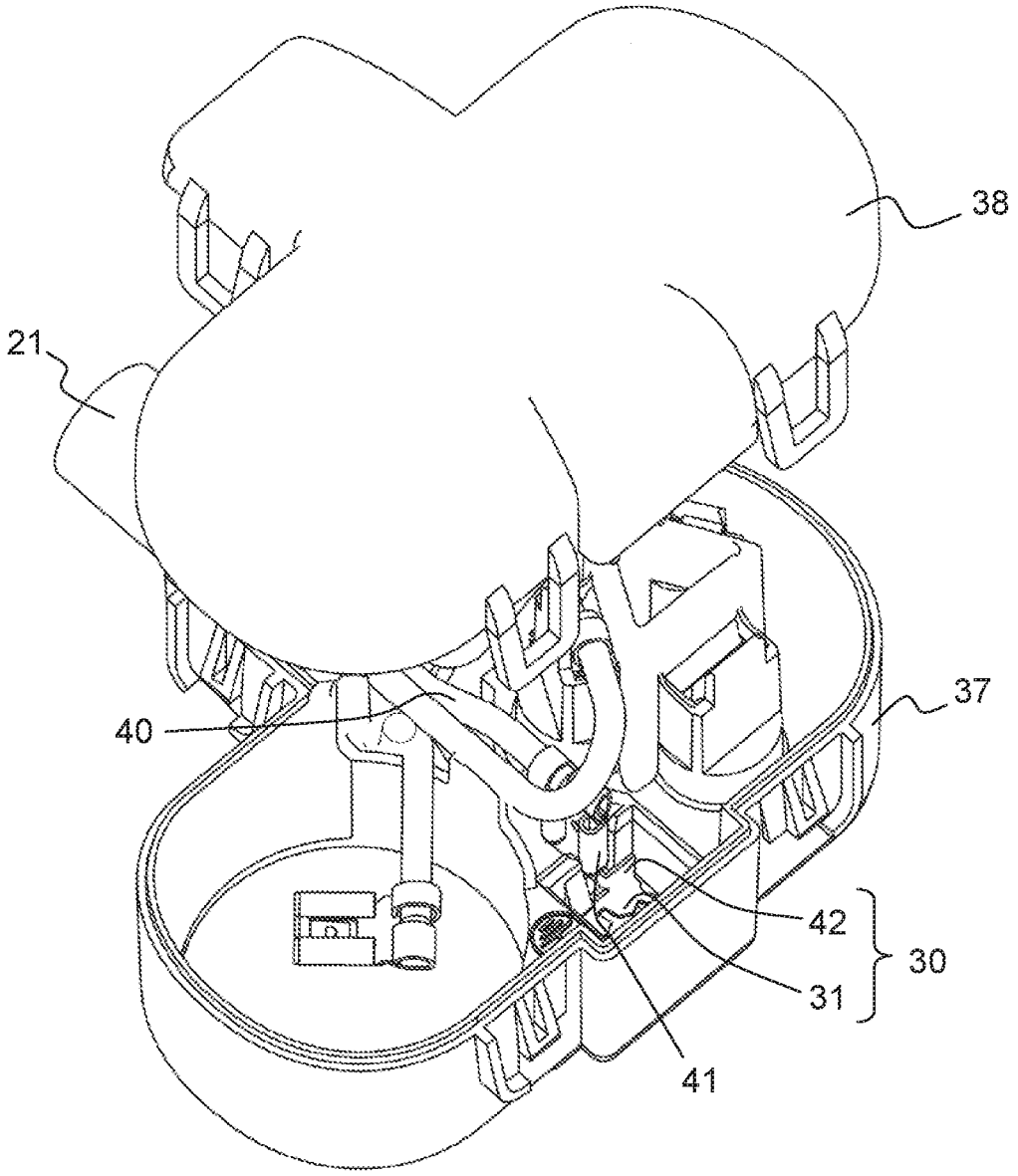
FIGS. 4 and 5 show, in perspective, the interior of the housing.
Figure 5:
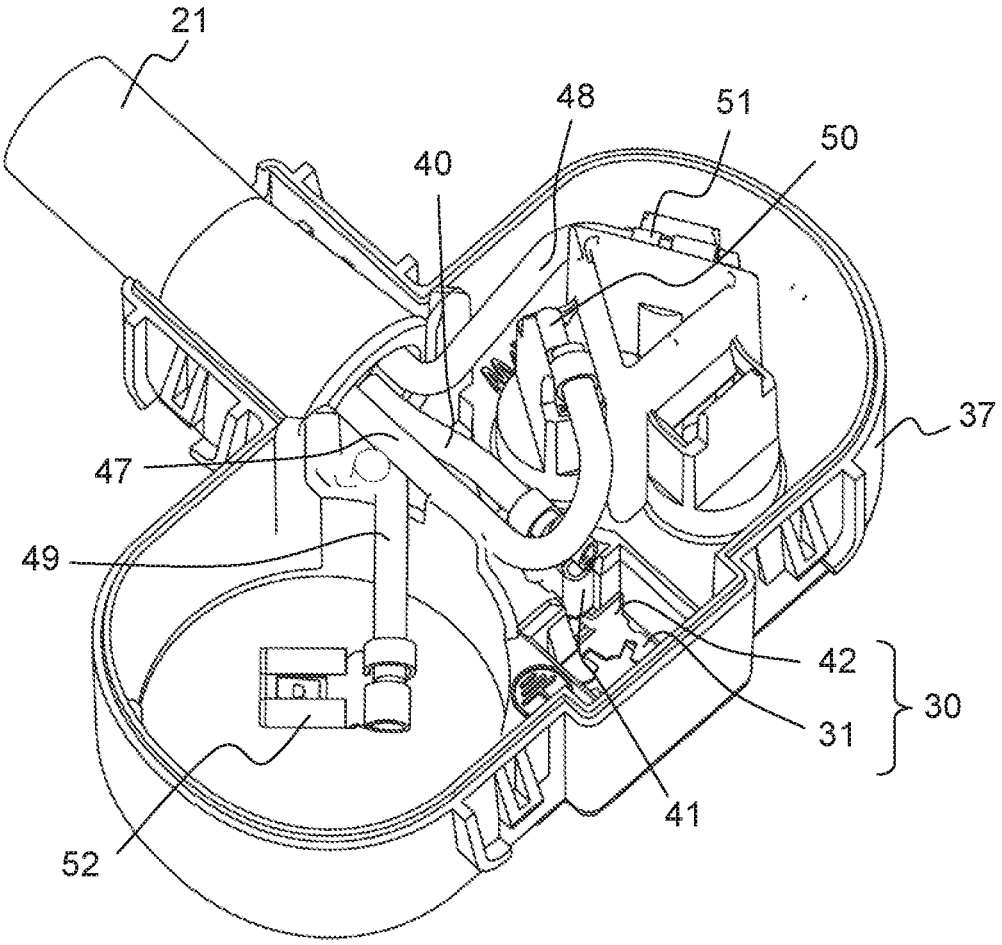

FIGS. 4 and 5 show, in perspective, the interior of the housing 20, the cover 38 being open in FIG. 4 and the cover being omitted in FIG. 5. The cable 21 includes an electric earth conductor 40 ending in an earth lug 41. Advantageously, the one-piece mechanical part 30 includes a tab 42 onto which the earth lug 41 is plugged. The tab 42 and the lug 41 allow intervention on the earth connection after the housing 20 is opened.

The tab 42 may have a width of 6.3 mm which can accommodate a lug 41 which is readily available from connector manufacturers. The lug 41 may be crimped or soldered onto the end of the earth conductor 40.

Advantageously, the part 30 has shapes defined in such a way that they may be formed from bent sheet metal of constant thickness. These shapes are visible in FIG. 3.

To accommodate a conventional lug 41, the tab 42 must have a thickness of around 0.8 mm. It is understood that the values given for the dimensions of the lug 41 are merely examples. Any other value is possible without exceeding the scope of the invention. However, depending on the material used to make the part 30, the thickness necessary to make the washer 31, and in particular the fins 33, may be different to the thickness of the tab 42. To adapt to the differing requirements in terms of thickness of the washer 31 and the tab 42, the tab 42 comprises two bends 43 and 44 to increase the functional thickness thereof in relation to the lug 41. To take the example of dimensions given above, the part 30 may be made of sheet metal with a thickness of 0.4 mm while connecting thereto a lug 41 suitable for a tab of 0.8 mm.

As mentioned above, the connection means 12 comprise three power supply terminals 14, 15 and 16 passing through the hermetic casing 11. The power supply terminals 14, 15 and 16 each include for example a power supply tab extending in the direction of insertion 22. To avoid cluttering the figures, the tabs bear the same reference signs as the terminals 14, 15 and 16. The cable 21 includes the earth conductor 40 and at least two electric power supply conductors 47 and 48 each ending in a lug 50 and 51, respectively, designed so as to each plug onto one of the power supply tabs 15 or 16 upon connection of the housing 20.

Figure 6:
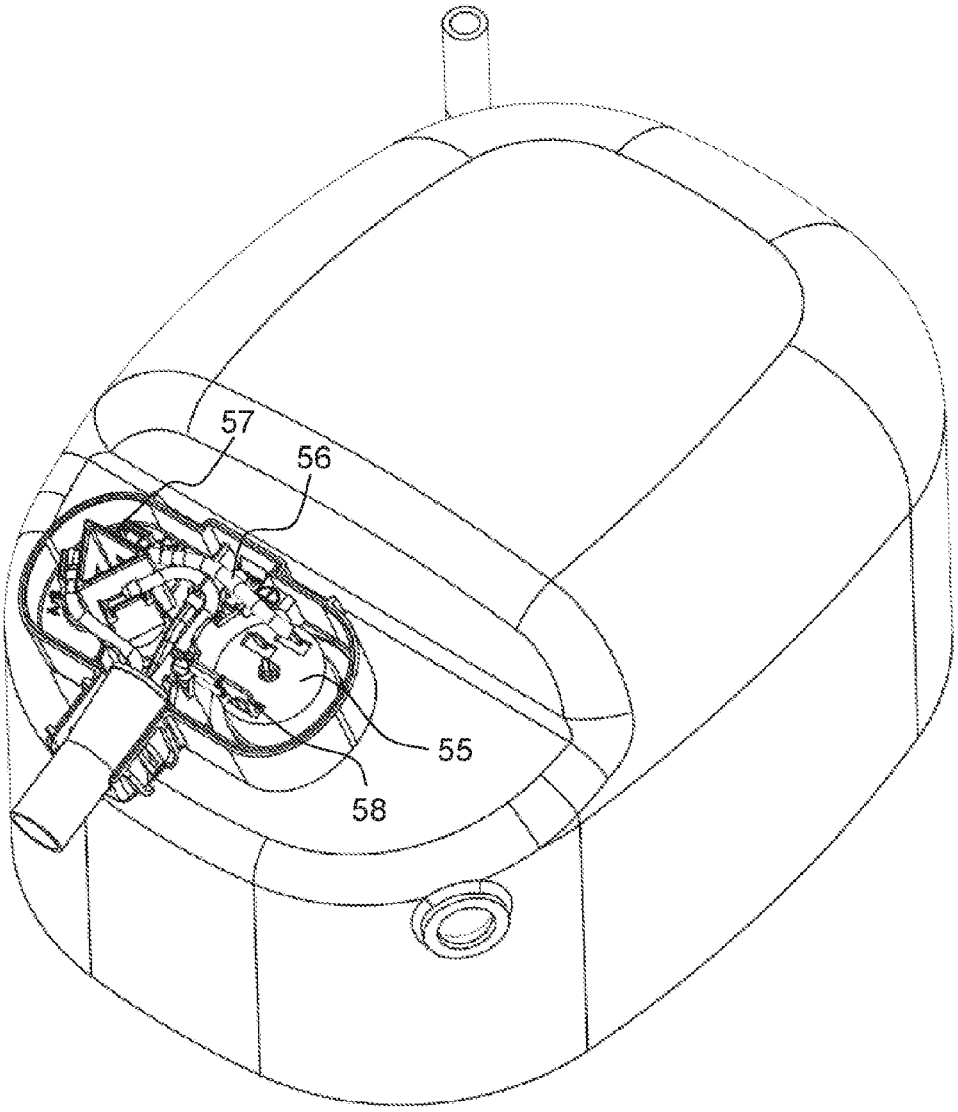
FIG. 6 shows the housing, open, in position on the compressor.

FIG. 6 shows the housing 20, open, in position on the compressor. Advantageously, the housing 20 includes a thermal protection component 55 for the compressor 10. The power supply terminals include a protective tab 14 extending in the direction of insertion 22. The thermal protection component 55 comprises an electric conductor 56 ending in a lug 57 designed to be plugged onto the protective tab 14. The cable 21 comprises a third electric power supply conductor 49 ending in a lug 52. In this variant, the cable 21 thus comprises four conductors: the earth conductor 40 and the three electric power supply conductors 47, 48 and 49. The electric conductor 49 is plugged onto a tab 58 belonging to the thermal protection component 55.

The non-return effect is effective when an operator tries to remove the housing 20 by pulling on the housing 20 in an opposite direction to the direction of insertion 22. However, it is possible to configure the non-return means to enable disengagement thereof by an additional maneuver other than pulling in an opposite direction to the direction of insertion 22.

This additional maneuver may for example involve inserting a tool into the housing 20 through an orifice provided for this purpose. The tool may for example be a flat blade screwdriver slipping between a fin 33 and the rod 13.

Figure 7:
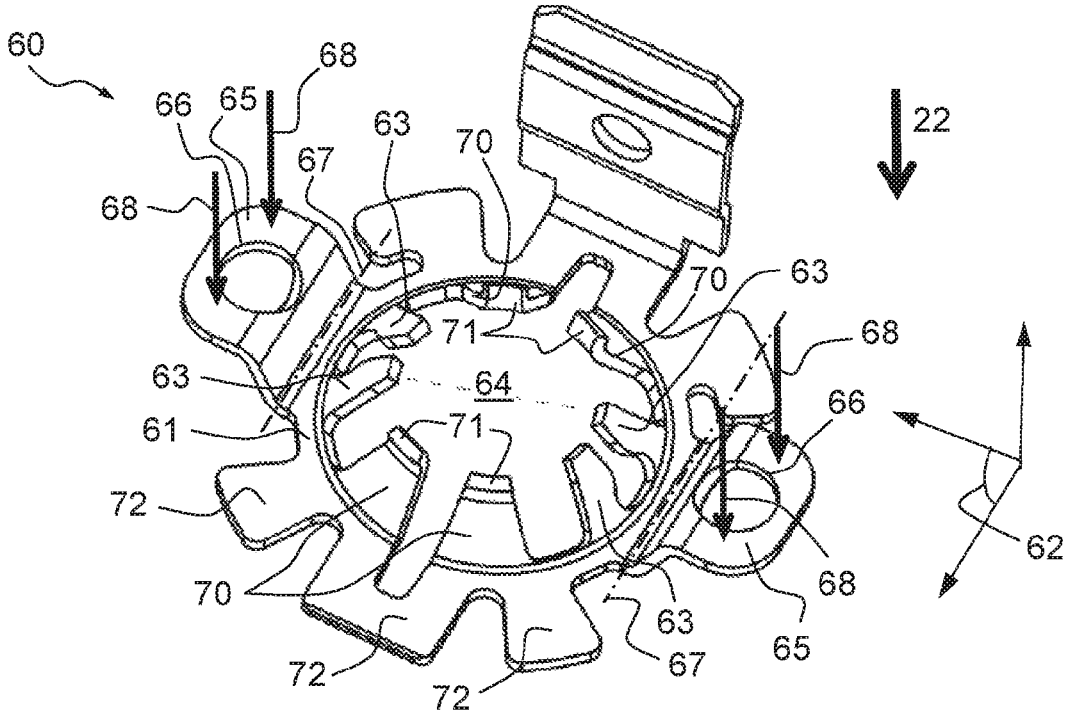
FIG. 7 shows an optimized variant of the part shown in FIG. 3.

FIG. 7 shows a one-piece part 60 constituting an alternative to the part 30, which in addition allows disengagement of the coupling. The part 60 includes means alternative to the use of a tool sliding between a fin 33 and the rod 13 enabling, with a pressing or pulling movement, disconnection without destroying the part 60.

The part 60 comprises a pierced washer 61 similar to the washer 31. The washer 61 extends in a plane 62 and is designed to surround the rod 13 when the housing 20 is connected on the rod 13. The washer 61 has at least one radial fin 63 partially blocking the hole 64 in the washer 61, so as to fit tightly on the rod 13. Here again, the washer 61 comprises several symmetrical fins 63, four in the example shown. The fins 63 are inclined relative to the plane 62 of the washer 61 in such a way that the inclination thereof is increased by elastic deformation upon insertion on the rod 13. The fins 63 are arranged in pairs, each pair of fins 63 bearing substantially diametrically opposite one another on the rod 13. As previously, simply pulling on the part 60 in an opposite direction to the direction 22 tends to increase the clamping force of the washer 61 on the rod 13 by bracing the fins 63 on the rod 13.

The connection of the housing 20 to the rod 13 includes means for releasing the bracing by means of a maneuver other than pulling in an opposite direction to the direction of insertion 22.

In the example shown, the one-piece part 60 comprises at least one wing 65, two wings 65 in the example shown, that can be maneuvered to move the fins 63 away from the rod 13. The wings 65 form protrusions extending outward from the washer 61. Each wing 65 is associated with a pair of fins 63. Each wing 65 comprises a bearing area, such as a hole 66 allowing a tool to pull on the wing 65 perpendicularly to the direction of insertion 22. It is for example possible to use snap ring pliers with two fingers, each being inserted in one of the holes 66. By maneuvering the snap ring pliers so as to move the holes away from the rod 13, the washer 61 is deformed and the fins 63 move away from the rod 13 following the movement of the wings 65. As an alternative to the holes 66, the wings 65 may each comprise a shoulder on which an appropriate tool can bear to locally deform the washer 61 by moving it away from the rod 13. The washer 61 is deformed in the plane 62.

Alternatively, it is possible to locally deform the washer 61 by twisting about an axis 67 perpendicular to the direction of insertion 22. Such twisting may be carried out by pressing on each of the wings 65 in the direction 22 as shown in FIG. 7 with the arrows 68. By pressing on the wings 65, the washer 61 is deformed and the fins 63 are deformed in the opposite direction to the wings 65, becoming disengaged from the rod 13. In other words, each wing 65 is configured in such a way that pressure on the wing 65 allows the corresponding fins 63 to be moved away from the rod 13.

Other fins 70 may help center the hole 64 on the rod 13. The fins 63 and 70 are distributed around the center of the hole 64 intended to coincide with the axis of the rod 13. Unlike the fins 63, the fins 70 each comprise a free end 71 bent outwardly in order to avoid bracing on the rod, allowing the fin 70 to slide against the rod when the housing 20 is disconnected from the rod 13.

The operation of deforming the washer 61 is performed after removing the cover 38 to access the part 60. All that is then required is simply to pull the base 37 in the opposite direction to the direction 22 to disconnect the housing 20.

Figure 8:
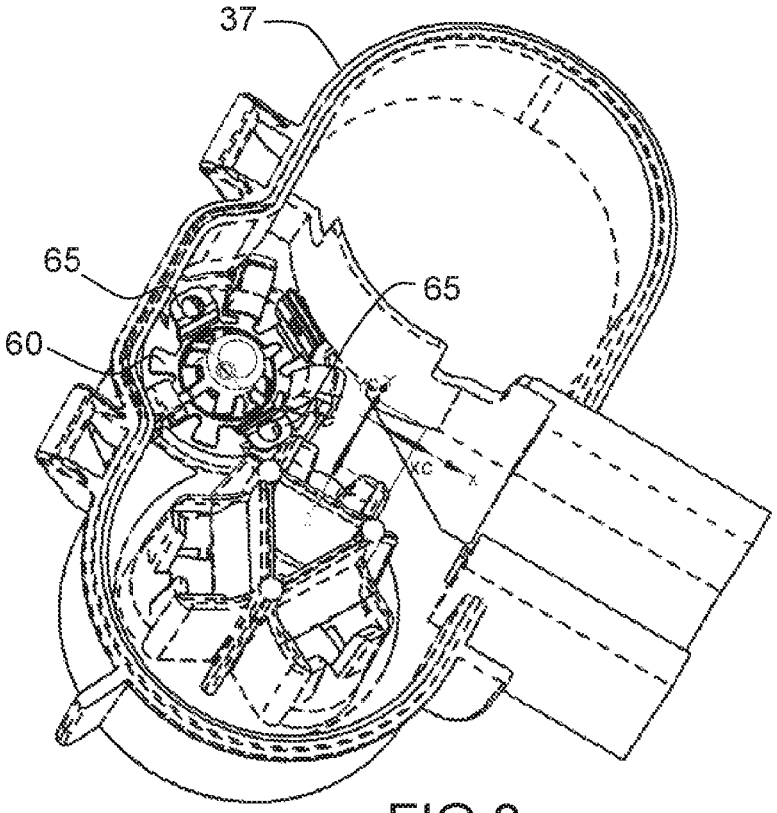
FIG. 8 shows the part of FIG. 7 mounted in the housing in the open position.

FIG. 8 shows the base 37 with the part 60 in position in the base 37. The base 37 is configured to allow access to the wings 65. The part 60 may include other wings 72 extending outwardly from the washer 61. The wings 72 keep the part 60 in position in the base 37.

The invention claimed is:

1. A sealed compressor comprising a motor pump unit, a hermetic casing and means of electrical connection, the motor pump unit being positioned inside the hermetic casing, the connection means allowing the motor pump unit to be powered electrically through the hermetic casing, the connection means comprising an earth rod and at least two power supply terminals, wherein the connection means comprise a mobile housing and a power supply cable, the housing being arranged at the end of the cable, connection of the housing to the earth rod and to the power supply terminals being achieved in a translational movement in a direction of insertion, wherein connection of the housing to the earth rod comprises non-return means that prevent the housing from moving in an opposite direction to the direction of insertion, wherein the earth rod is formed of a rod extending out of the hermetic casing in a direction comprising the direction of insertion, wherein the housing comprises a one-piece mechanical part intended to ensure the connection of the housing to the earth rod, wherein the housing comprises two parts: a base and a cover, wherein the mechanical part is rigidly secured to the base, wherein the cover is removably attached to the base and wherein the base is made of an electrically insulating material so as to avoid any electrical contact between components located inside the housing and the hermetic casing.

2. The sealed compressor as claimed in claim 1, wherein the non-return means prevent the housing from moving in an opposite direction to the direction of insertion simply due to pulling on the housing, and wherein the non-return means allow the housing to move in an opposite direction to the direction of insertion when the pulling force in an opposite direction to the direction of insertion is combined with another maneuver other than pulling.

3. The sealed compressor as claimed in claim 1, wherein the connection of the housing to the earth rod comprises means for bracing on the earth rod.

4. The sealed compressor as claimed in claim 2, wherein the connection of the housing to the earth rod includes means for releasing the bracing by means of a different maneuver.

5. The sealed compressor as claimed in claim 1, wherein the housing is connected to the earth rod in such a way that an attempt at disconnection simply by pulling in an opposite direction to the direction of insertion will destroy the connection to the earth rod.

6. The sealed compressor as claimed in claim 1, wherein the one-piece mechanical part includes a pierced washer extending in a plane, the washer being designed to surround the rod so that the plane of the washer is placed perpendicular to the direction comprising the direction of insertion, wherein the washer has at least one radial fin partially blocking the hole in the washer, so as to fit tightly on the rod, ensuring electrical connection to the earth rod, and wherein the fin is inclined relative to the plane of the washer in such a way that the inclination thereof is increased during insertion by elastic deformation, thereby forming the non-return means.

7. The sealed compressor as claimed in claim 6, wherein the washer comprises several fins.

8. The sealed compressor as claimed in claim 6, wherein the one-piece part comprises a wing that can be maneuvered to move the fin away from the rod.

9. The sealed compressor as claimed in claim 8, wherein the wing comprises a bearing area allowing a tool to pull on the wing perpendicularly to the direction of insertion.

10. The sealed compressor as claimed in claim 8, wherein the wing is configured in such a way that pressure on the wing allows the fin to be moved away from the rod.

11. The sealed compressor as claimed in claim 1, wherein the cable includes an electric earth conductor and in that wherein the one-piece mechanical part includes a tab onto which the earth lug is intended to be plugged.

12. The sealed compressor as claimed in claim 1, wherein the one-piece mechanical part has shapes defined in such a way that they may be formed from bent sheet metal of constant thickness.

13. The sealed compressor as claimed in claim 11, wherein the tab on which the earth lug is intended to be plugged comprises two bends so as to adapt to differing requirements in terms of thickness of the washer and the tab on which the earth lug is plugged.

14. The sealed compressor as claimed in claim 1, wherein the power supply terminals each include a power supply tab extending in the direction of insertion and wherein the cable includes at least two electric power supply conductors each ending in a lug designed so as to each plug onto one of the power supply tabs upon connection of the housing.

15. The sealed compressor as claimed in claim 1, wherein the housing includes a thermal protection component for the compressor, wherein the power supply terminals include a protective tab extending in the direction of insertion and wherein the thermal protection component comprises an electric conductor ending in a lug designed to be plugged onto the protective tab.

16. The sealed compressor as claimed in claim 1, wherein the housing comprises an electrically insulating material arranged in such a way as to avoid any electrical contact between components located inside the housing and the hermetic casing.

* * * * *